United States Patent [19]

Bowser

[11] 4,346,057

[45] Aug. 24, 1982

[54] TEST TUBE EVAPORATOR

[76] Inventor: Everett N. Bowser, 715 N. Main St., Glen Ellyn, Ill. 60137

[21] Appl. No.: 275,862

[22] Filed: Jun. 22, 1981

[51] Int. Cl.[3] ..... B10L 3/00

[52] U.S. Cl. ..... 422/101; 34/92; 159/22; 159/DIG. 16; 312/209; 422/104

[58] Field of Search ..... 422/99, 101, 102, 104; 312/209; 159/22, DIG. 16; 34/92

[56] References Cited

U.S. PATENT DOCUMENTS 4,003,713 1/1977 Bowser ..... 422/101

*Primary Examiner*—Ronald E. Serwin

*Attorney, Agent, or Firm*—David C. White

[57] ABSTRACT

This invention is a device for increasing the rate of evaporation from tubes, usually test tubes, by the introduction of a partial vacuum or by using a stream of gas through needles which extend into the tubes. This invention is an improvement on U.S. Pat. No. 4,003,713. The improvement is to divide the device into two separate units which may either be used together or independently of each other. This allows the operator to run two different samples at one time or he may run one smaller sample without waste resulting from unused needles. Furthermore, the improvement provides for variations in the height of the needles above the substance to be evaporated. This increases the speed and efficiency of the evaporation. Finally the improvement allows the operator to use the device as a drying rack for small glassware.

2 Claims, 3 Drawing Figures

17
16
17
16
16
16
28
24
28
24
19
23
28
33
33
18
24
24
20
28
22
20
20
25
29
27
28
26
27
20
20
28
21
28
28
20
28
25
20
15
20
20
28

TEST TUBE EVAPORATOR

BACKGROUND OF THE INVENTION

This invention relates to an apparatus designed to increase the rate of evaporation of the contents of a number of test tubes. The evaporation is accomplished either by the imposition of a partial vacuum or by the injection of a stream of gas into a test tube containing the sample.

U.S. Pat. No. 4,003,713 involved a device which used the principle of inducing a partial vacuum to increase the rate of evaporation and also the concept of inducing a stream of gas above the solvent to be evaporated to increase the rate of evaporation. The present invention is an improvement of U.S. Pat. No. 4,003,713. The prior patent required pumping gas through all of the needles every time the device was used and this led to wasted gas if the rack was not full of test tubes. If a vacuum was used the vacuum was imposed through all of the needles regardless of whether the rack was full of tubes. The present improvement allows the operator to either pump gas into, or impose a vacuum only through half of the device. The operator has the option of not using the other half of the device or he can use a different gas in that half. Finally the operator could impose a vacuum in one half and pump a gas into the other half of the tubes.

The prior patent also did not allow for varations in the depth of the needles in the tubes. As a result the operation of the device was not always efficient. The present improvement allows the operator to vary the depth of the needles in the tubes and thus vary the height of the needle above the solvent. Therefore the efficiency of the device would be improved. Also, the present improvement allows the device to be inverted and used as a drying rack for small glassware.

OBJECTS AND SUMMARY OF THE INVENTION

One of the main objects of this invention is to improve on U.S. Pat. No. 4,003,713 by dividing the device into two separate independent units. This change results in increased economy and versatility. The two separate units can be operated together to provide one large evaporating device. One unit can be operated by itself if the sample to be evaporated is small. One unit could use a vacuum to evaporate a sample while the other unit used a stream of gas. Finally a different gas could be used in each unit at the same time. These options allow for the evaporation of two samples at the same time with each sample being evaporated in a different way. Smaller samples can be used without wasting gas because the rack is not full.

Another important object of this invention is to allow the operator to vary the height of the needles above the solvent. This results in increased efficiency of the evaporating process.

Another object is to provide a rack for the drying of small glassware when the device is inverted.

This invention is a device for increasing the rate of evaporation from tubes, usually test tubes, by the introduction of a partial vacuum or by using a stream of gas through needles which extend into the tubes. This invention is an improvement on U.S. Pat. No. 4,003,713. The improvement is to divide the device into two separate units which may either be used together or independently of each other. This allows the operator to run two different samples at one time or he may run one smaller sample without waste resulting from unused needles. Further, the improvement provides for variations in the height of the needless above the substance to be evaporated. This increases the speed and efficiency of the evaporation. Finally the improvement allows the operator to use the device as a drying rack for small glassware.

DETAILED DESCRIPTION OF THE PREFERRED EMBODIMENT

Figure 2:
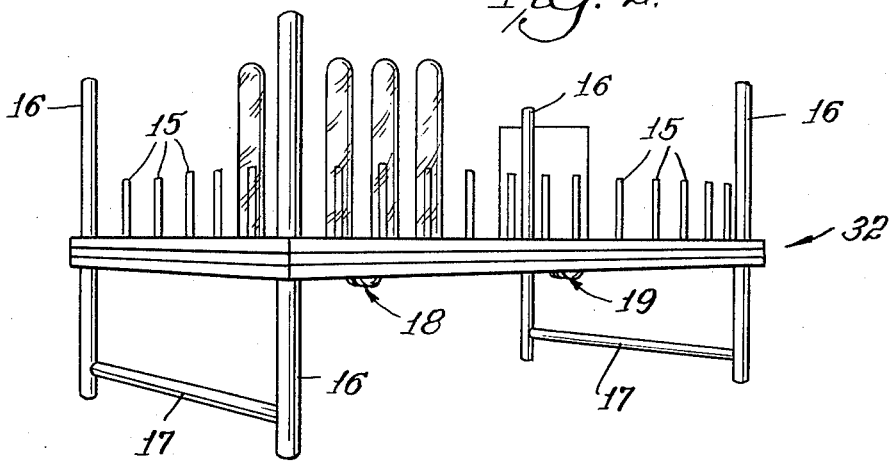
FIG. 2 is an exploded view of the chamber.
Figure 1:
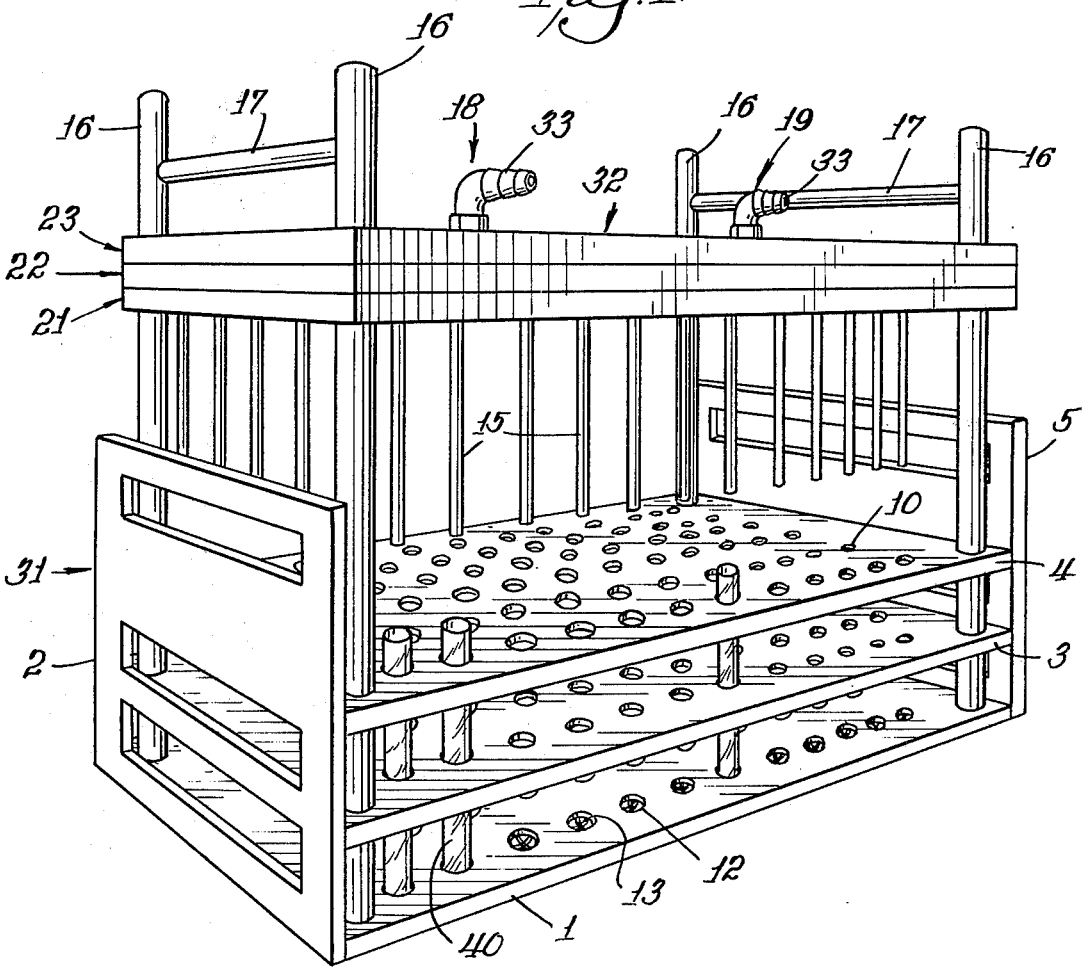
FIG. 1 is a perspective view of the rack for holding the tubes.

As shown in FIG. 1, the multiple test tube evaporator includes a rack 31, which is usually constructed of a suitable plastic material. The rack consists of a base 1 which supports two vertical side walls 2 and 5. Rigidly attached to the inner surface of the side walls 2 and 5, and extending parallel to base 1 are supports 3 and 4. The base 1 is provided with concave seats 12. Each seat 12 has a bottom which is open with a webbing 13 to support the sample tube. In each support 3 and 4 openings are cut 10 and 11 which are in line with the concave seats 12 in base 1 so that in combination seat 12 and openings 10 and 11 would support tubes in an upright position.

Figure 3:
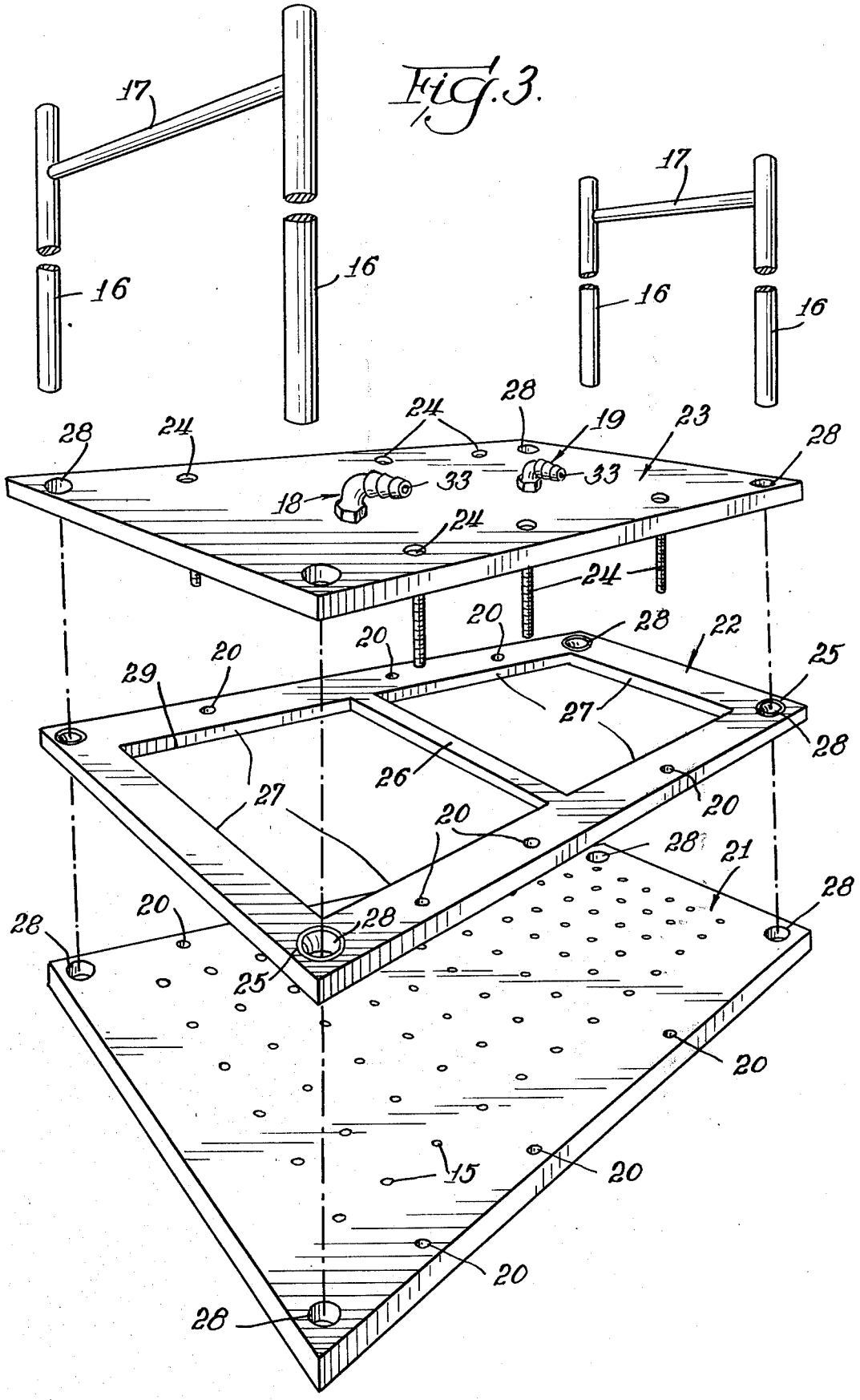
FIG. 3 is a perspective view of the chamber, the support posts, and the needles inverted and used as a drying rack.

The chamber 32 is supported by four posts 16 which are inserted through apertures 28 in the outer walls of the chamber 32. These apertures are shown in FIG. 3. The posts 16 on each side of the chamber 32 are connected by bars 17 for added rigidity and ease of adjustment. O-rings 25 are held in apertures 28 in between individual parts of the chamber 32 and are fitted around the posts 16. The O-rings 25 restrict the movement of the chamber 32 up and down the posts 16. The chamber 32 may be moved up and down by the operator to adjust the height of the needles 15 above the material to be evaporated. Once the proper height is achieved the O-rings 25 will hold the chamber at that height. The posts 16 can be lightly greased to each the movement of the chamber 32.

The chamber 32 consists of three separate parts, a top wall 23, a chamber wall 22, and a bottom wall 21. The top wall 23 is a flat piece of material containing an aperture 28 at each corner for posts 16. The top wall 23 supports intake nozzle 18 and 19 which are fitted with suitable friction connectors 33. The nozzle 18 and 19 are attached above openings in the top wall 23 so that gas may flow into and out of the interior of the chamber 32 through the nozzles 18 and 19.

The bottom wall 21 is a flat piece of material which is pierced by apertures 28 for the posts 16. These apertures 28 are aligned with the apertures 28 in the top wall 23 and chamber wall 22. Bottom wall 21 is pierced by an array of hollow needles 15 which extend downward from bottom wall 21 so that gas may flow between the chamber 32 and the various sample tubes through needles 15.

As shown in FIG. 3, chamber wall 22 separates top wall 23 and bottom wall 21 and contains side walls 27 and dividing wall 26. When chamber wall 22 is placed between top wall 23 and bottom wall 21 two exchange chambers are formed shown as 29 and 30. These exchange chambers 29 and 30 consist of the space bounded on top by top wall 23, on the bottom by bottom wall 21. The sides of the chambers 29 and 30 are formed by dividing wall 26 and side wall 27. Nozzle 18 opens into exchange chamber 29 and nozzle 19 opens into chamber 30. Each exchange chamber 29 and 30 has its own separate array of needles 15 that pierce bottom wall 21. Chamber wall 22 has apertures 28 alined with the similar openings in top wall 23 and bottom wall 21. The apertures 28 in chamber wall 22 are a bit larger than the similar openings in top wall 23 and bottom wall 21. This is to accommodate the size of the O-rings 25. The O-rings 25 fit within aperture 28 in chamber wall 22 and are restrained by the aperture 28 in top wall 23 and bottom wall 21 which are a bit smaller.

Holes 20 are in all three parts of the chamber 32 and are aligned so that screw 24 can be inserted and bind top wall 23, chamber wall 22 and bottom wall 21 together. The chamber 32 may then be moved up and down the posts 16 as one unit.

In use the sample tubes are placed through openings 10 and 11 into seats 12 in the rack 31, the chamber 32 is on the posts 16 with the needles 15 extending downward. The posts 16 are inserted in the four corner openings 10 and 11 and rest on the four corner seats 12 of the rack 31. The needles 15 extending downward into the tubes 40. The operator then adjusts the height of the needles 15 above the material to be evaporated by raising or lowering the chamber 32. Then if the material is to be evaporated by the input of a steam of gas the operator hookes up tubing from the source of the gas to the friction connectors 33. The operator may use a different gas for each nozzles 18 and 19. If this is done, half of the tubes 40 would be evaporated using one gas and the other half of the tubes 40 would be evaporated with another gas. If only one side of the evaporator is used the operator would only hook up the gas to one of the two nozzles 18 or 19, and gas would then only flow through half of the evaporator and a small sample could be evaporated without waste. If the operator wished to use the same gas on both sides of the evaporator he could hook a Y connector to nozzles 19 and 18 and then connect them to one source. The operator may also use half the evaporator for evaporation by inputing gas and use the other half for evaporation by a partial vacuum. He would connect the friction connector 33 on the side to be used with a gas to a gas source. He would then connect the friction connector 33 on the side to be used as partial vacuum to a vacuum source. Both sides could also be used in vacuum evaporation with the use of a Y connector as described above.

When gas in brought in for evaporation the gas is drawn in through nozzles 18 and 19 into exchange chambers 29 and 30. The gas then goes through needles 15 and thus into the tubes 40 to speed evaporation. If a vacuum is used the gasses in the tubes are drawn through needles 15 into exchange chambers 29 and 30 and out through nozzles 18 and 19.

To use the evaporator as a drying rack the posts 16 are withdrawn from rack 31. The chamber 32 and posts 16 are inverted and placed on a table or counter. The glassware can then be placed over needless 15 which support the glassware while the glassware drains and dries. Again evaporation can be speed up by using a gas or a vacuum connected to the nozzles 18 and 19.

Thus, an improved apparatus for evaporation has been provided.

I claim:

1. A test tube evaporator comprising;

a rack having a substantially rectangularly shaped base and upstanding side walls;

supports extending parallel to the base between the side walls below a midline of the said walls;

means provided by the base for receiving the closed end of a test tube;

means provided by the supports, in vertical alignment with the receiving means provided by the base, retaining the test tubes in a perpendicular position relative to the receiving means;

a chamber removably carried between the upstanding side walls in spaced parallel relation above the supports and the base;

an evaporating needle depending from the underside of and having communication with the chamber concentrically of the means provided by the base for receiving the closed end of a test tube;

means to support the chamber at variations in height above the closed end of a test tube;

and means to support the chamber in an inverted position, separated from the rack, so that the evaporating needles depending from the chamber are in an upstanding direction, the means to support the chamber at variations in height above the closed end of a test tube being the same as the means to support the chamber in an inverted position.

2. A test tube evaporator defined by claim 1, wherein the chamber comprises a pair of independent exchange chambers.

* * * * *